US010513814B2

(12) United States Patent
Hashimoto

(10) Patent No.: US 10,513,814 B2
(45) Date of Patent: Dec. 24, 2019

(54) WASHING METHOD

(71) Applicant: HAPPY CO., LTD., Uji-shi, Kyoto (JP)

(72) Inventor: Hideo Hashimoto, Uji (JP)

(73) Assignee: HAPPY CO., LTD., Kyoto (JP)

( * ) Notice: Subject to any disclaimer, the term of this patent is extended or adjusted under 35 U.S.C. 154(b) by 316 days.

(21) Appl. No.: 15/321,579

(22) PCT Filed: Oct. 29, 2015

(86) PCT No.: PCT/JP2015/080521
§ 371 (c)(1),
(2) Date: Dec. 22, 2016

(87) PCT Pub. No.: WO2016/080170
PCT Pub. Date: May 26, 2016

(65) Prior Publication Data

US 2017/0211219 A1 Jul. 27, 2017

(30) Foreign Application Priority Data

Nov. 21, 2014 (JP) ..... 2014-249332

(51) Int. Cl.
*D06F 35/00* (2006.01)
*D06F 39/00* (2006.01)
(Continued)

(52) U.S. Cl.
CPC ..... *D06F 35/006* (2013.01); *D06F 33/02* (2013.01); *D06F 37/04* (2013.01); *D06F 37/304* (2013.01);
(Continued)

(58) Field of Classification Search
CPC ..... D06F 33/02; D06F 35/006; D06F 37/04; D06F 37/304; D06F 39/087;
(Continued)

(56) References Cited

U.S. PATENT DOCUMENTS 2,513,844 A * 7/1950 Castner ..... D06F 13/02 188/378
2,539,533 A * 1/1951 Douglas ..... D06F 37/225 210/363
(Continued)

FOREIGN PATENT DOCUMENTS

JP 55-163980 U 11/1980
JP 2004-236704 A 8/2004
(Continued)

OTHER PUBLICATIONS

Machine Translation of JP 2012024465 to Hashimoto et al., Feb. 2012. (Year: 2012).*
(Continued)

*Primary Examiner* — Benjamin L Osterhout
(74) *Attorney, Agent, or Firm* — Global IP Counselors, LLP

(57) ABSTRACT

A washing method comprising: suspending and washing laundry in a washing liquid that is supplied to a laundry tub; agitating and washing the laundry with a baffle in the washing liquid at a liquid level that is lower than a liquid level of the washing liquid that is supplied to the laundry tub during the suspending and washing of the laundry; and increasing or decreasing a liquid level of the washing liquid continuously between the suspending and washing of the laundry and the agitating and washing of the laundry while the laundry tub is spinning.

20 Claims, 6 Drawing Sheets

(51) Int. Cl.

| | |
|---|---|
| ***D06F 37/30*** | (2006.01) |
| ***D06F 39/08*** | (2006.01) |
| ***D06F 33/02*** | (2006.01) |
| ***D06F 37/04*** | (2006.01) |
| *D06F 43/02* | (2006.01) |

(52) U.S. Cl.
CPC ..... *D06F 39/003* (2013.01); *D06F 39/087* (2013.01); *D06F 43/02* (2013.01); *D06F 2202/085* (2013.01); *D06F 2204/08* (2013.01)

(58) Field of Classification Search
CPC ..... D06F 39/003; D06F 2204/08; D06F 2202/085; D06F 43/02
See application file for complete search history.

(56) References Cited

U.S. PATENT DOCUMENTS 3,402,576 A * 9/1968 Krupsky ..... A47L 15/0097 134/111
5,115,651 A * 5/1992 Nukaga ..... D06F 25/00 210/363
5,191,667 A * 3/1993 Roy ..... D06F 35/006 8/158
5,199,127 A * 4/1993 Van Newenhizen ..... D06F 35/006 8/158
5,249,441 A * 10/1993 Pastryk ..... D06F 37/12 210/147
5,271,251 A * 12/1993 Kovich ..... D06F 35/006 68/171
5,582,040 A * 12/1996 Khan ..... D06F 37/225 210/144
5,768,730 A * 6/1998 Matsumoto ..... D06F 25/00 210/144
2002/0020196 A1* 2/2002 Kakuda ..... D06F 23/06 68/12.06
2005/0268670 A1* 12/2005 Hirasawa ..... D06F 35/007 68/12.06
2014/0352077 A1* 12/2014 Leitert ..... D06F 39/003 8/137

FOREIGN PATENT DOCUMENTS

| | | | |
|---|---|---|---|
| JP | 2008-005853 | A | 1/2008 |
| JP | 2008-012274 | A | 1/2008 |
| JP | 2010-022645 | A | 2/2010 |
| JP | 2011-115249 | A | 6/2011 |
| JP | 2012-024465 | A | 2/2012 |

OTHER PUBLICATIONS

International Search Report of the corresponding International Application No. PCT/JP2015/080521, dated Dec. 22, 2015.

* cited by examiner

WASHING METHOD

CROSS-REFERENCE TO RELATED APPLICATIONS

This application is a U.S. National stage of International Application No. PCT/JP2015/080521 filed on Oct. 29, 2015. This application claims priority to Japanese Patent Application No. 2014-249332 filed with Japan Patent Office on Nov. 21, 2014. The entire disclosure of Japanese Patent Application No. 2014-249332 is hereby incorporated herein by reference.

BACKGROUND

Field of the Invention

The present invention relates to a washing method for washing laundry, and more particularly relates to a washing device with which laundry is washed in a laundry tub that is filled with a washing liquid including water, a petroleum-based solvent or an organic solvent, and the like.

Background Information

With a conventional washing device, it is very common for it to be equipped with a laundry tub whose rotational axis is in the horizontal direction or is inclined from the horizontal direction (hereinafter referred to simply as the "horizontal inclined direction"). With a washing device comprising a laundry tub (drum) whose rotational axis is in the horizontal direction or the horizontal inclined direction, the laundry tub is spun so that the laundry is moved to the upper side of the laundry tub by a baffle (vane) that protrudes from the inner wall surface of the laundry tub, after which the laundry is allowed to fall under its own weight. The laundry is washed by the impact caused by the collision with the inner wall surface of the laundry tub when the laundry falls (impact washing mode).

Meanwhile, the applicant has proposed a washing method (see Japanese Laid-Open Patent Application Publication No. 2008-5853 (Patent Literature 1)) and washing devices (see Japanese Laid-Open Patent Application Publication Nos. 2008-12274 and 2010-22645 (Patent Literatures 2 and 3)) in which a laundry tub whose center axis is in the horizontal direction is installed in the interior of a casing (water tank), this casing is filled with a washing liquid, and the laundry tub (drum) is spun, which washes the laundry held in the laundry tub by suspending it in the washing liquid. With the washing devices in the above-mentioned Patent Literature, bumps that are continuous in the peripheral direction are provided on the inner wall surface of the laundry tub, and this tub is spun to generate eddy currents at the bumps on the inner wall surface of the laundry tub, in the washing liquid on the inner wall surface side of the laundry tub. These eddy currents are formed continuously along the inner wall surface of the laundry tub, which generates a large flow along the rotation of the laundry tub in the washing liquid inside the laundry tub. Since the large flow and the eddy currents thus generated affect the laundry, the laundry is suspended and spreads out as if drifting within the laundry tub. Accordingly, not only is there a larger contact surface between the washing liquid and the laundry, but the washing liquid penetrates the laundry with higher force, and as a result the washing effect of the washing liquid is improved against soil on the laundry.

This vortex-like rotational flow is formed in the various recesses, so the washing liquid that fills the casing flows at different speeds in a substantially concentric circular shape in the radial direction of the laundry tub, forming a pressure distribution in the radial direction of the laundry tub. The pressure distribution formed in the radial direction of the laundry tub suspends the laundry within the laundry tub, so the result is that the laundry that is drifting suspended in the washing liquid spreads out, which promotes the washing effect and also prevents damage to the laundry. The washing mode in the washing devices in the Patent Literature give above shall be termed "simulated zero-gravity washing mode."

In Japanese Laid-Open Patent Application Publication No. 2011-115249 (Patent Literature 4), it is proposed that even laundry with a low specific gravity, etc., can be properly washed by changing the liquid level of the washing liquid supplied into the laundry tub according to the type of laundry. In Japanese Laid-Open Patent Application Publication No. 2012-24465 (Patent Literature 5), it is proposed that the liquid level of the washing liquid supplied into the laundry tub is determined, and the system switches between an impact washing mode and a simulated zero-gravity washing mode according to the liquid level of the washing liquid.

SUMMARY

The washing liquids utilized in washing with a washing device such as this are classified into water-based washing liquids such as water or a solvent in which a surfactant is admixed in water, and nonaqueous washing liquids such as petroleum-based solvents and organic solvents. When a water-based washing liquid is used, water-soluble stains on the laundry come out, but some laundry fabrics or fibers may be damaged, shrink, or harden, so the laundry may end up being in a bad state after washing. On the other hand, when a nonaqueous washing liquid is used, the risk of damage to the laundry that is encountered with water-based washing liquids can be avoided, but water-soluble stains cannot be reliably removed.

However, with the simulated zero-gravity washing modes proposed by the applicant in Patent Literature 1 to 5, shrinkage and hardening of fabrics and fibers of the laundry are less likely to be caused by a water-based washing liquid, and damage can be further prevented. Also, stains can be removed even without using an organic solvent or a petroleum-based solvent as the washing liquid, so this washing method is extremely environmentally friendly.

With the washing device in Patent Literature 5, whether to use an impact washing mode or a simulated zero-gravity washing mode is determined by the type of laundry, and the liquid level of the washing liquid is determined to match. However, even better stain removal can be anticipated if the same load of laundry is subjected to both impact washing mode and simulated zero-gravity washing mode.

The present invention was conceived in an effort to solve the above problem, and provides a washing method with which the stain removal effect from a washing operation lasting a relatively short time can be improved by combining an impact washing mode and a simulated zero-gravity washing mode for the same load of laundry.

To achieve the stated object, the primary feature is a washing method used in a washing device comprising a laundry tub that is spun by a rotary shaft that is horizontal or is inclined towards the horizontal direction from the vertical direction and in the interior of which laundry is held, a casing that covers the laundry tub and into which a washing liquid is supplied, a bumpy curved surface that is provided on the inner wall surface of the laundry tub and that is bumpy in the radial direction of the laundry tub, and at least one baffle that protrudes from the inner wall surface of the laundry tub in the radial direction of the laundry tub and whose height in the radial direction of the laundry tub is greater than the height of the convex parts of the bumpy curved surface, the method comprising as steps for washing laundry a first washing step of suspending and washing the laundry in a washing liquid that is supplied to the laundry tub, and a second washing step of agitating the laundry with the baffle and washing it in the washing liquid at a lower liquid level than the liquid level of the washing liquid supplied to the laundry tub in the first washing step, wherein the liquid level of the washing liquid is continuously or intermittently increased or decreased between the first washing step and the second washing step while the laundry tub is spun.

With the present invention, the laundry stain removal effect can be improved by combining an impact washing mode and a simulated zero-gravity washing mode on the same load of laundry.

DETAILED DESCRIPTION OF EMBODIMENTS

Figure 1:
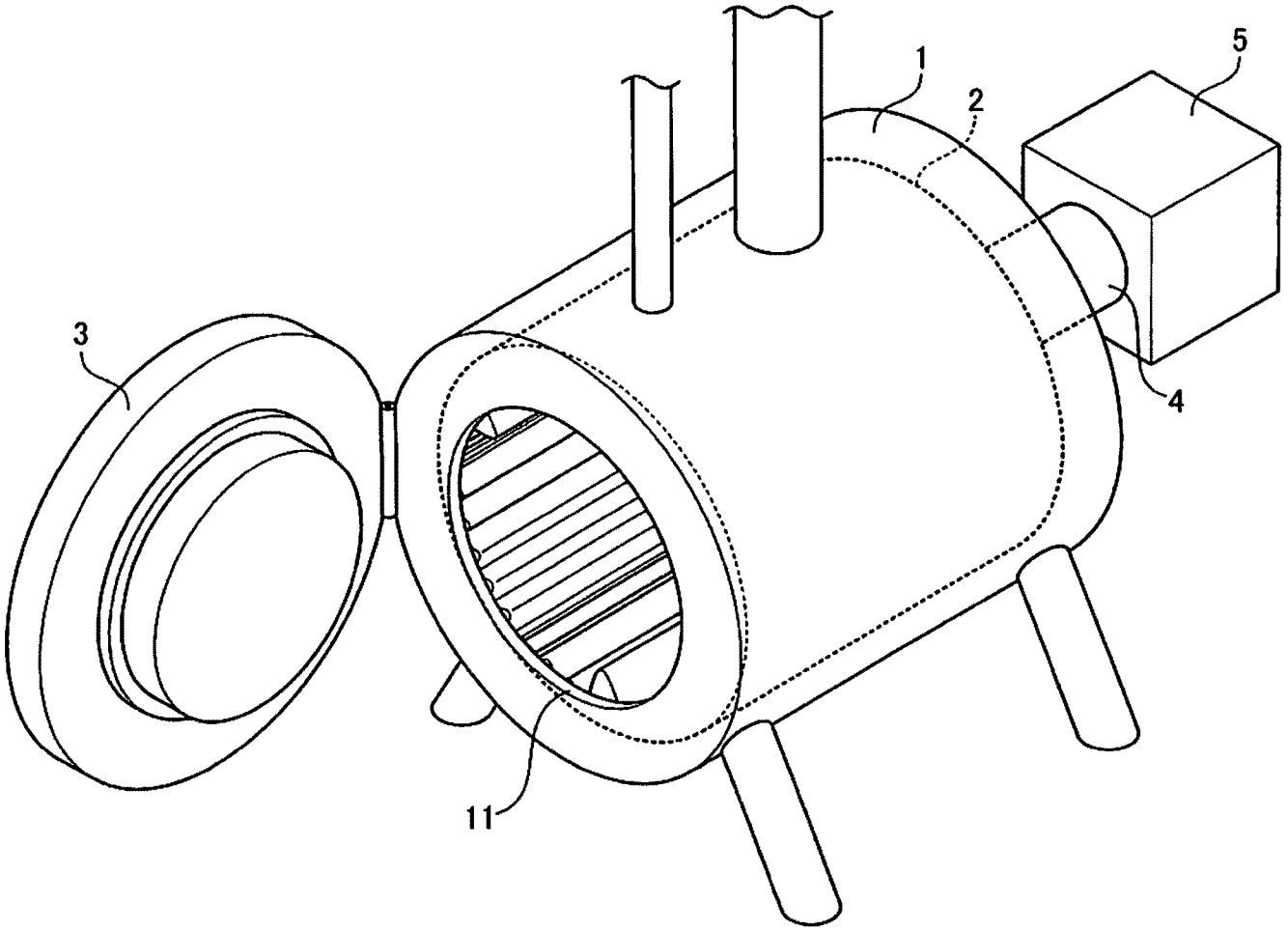
FIG. 1 is a simplified oblique view of the configuration of the washing device used in the washing method of the present invention.
Figure 2:
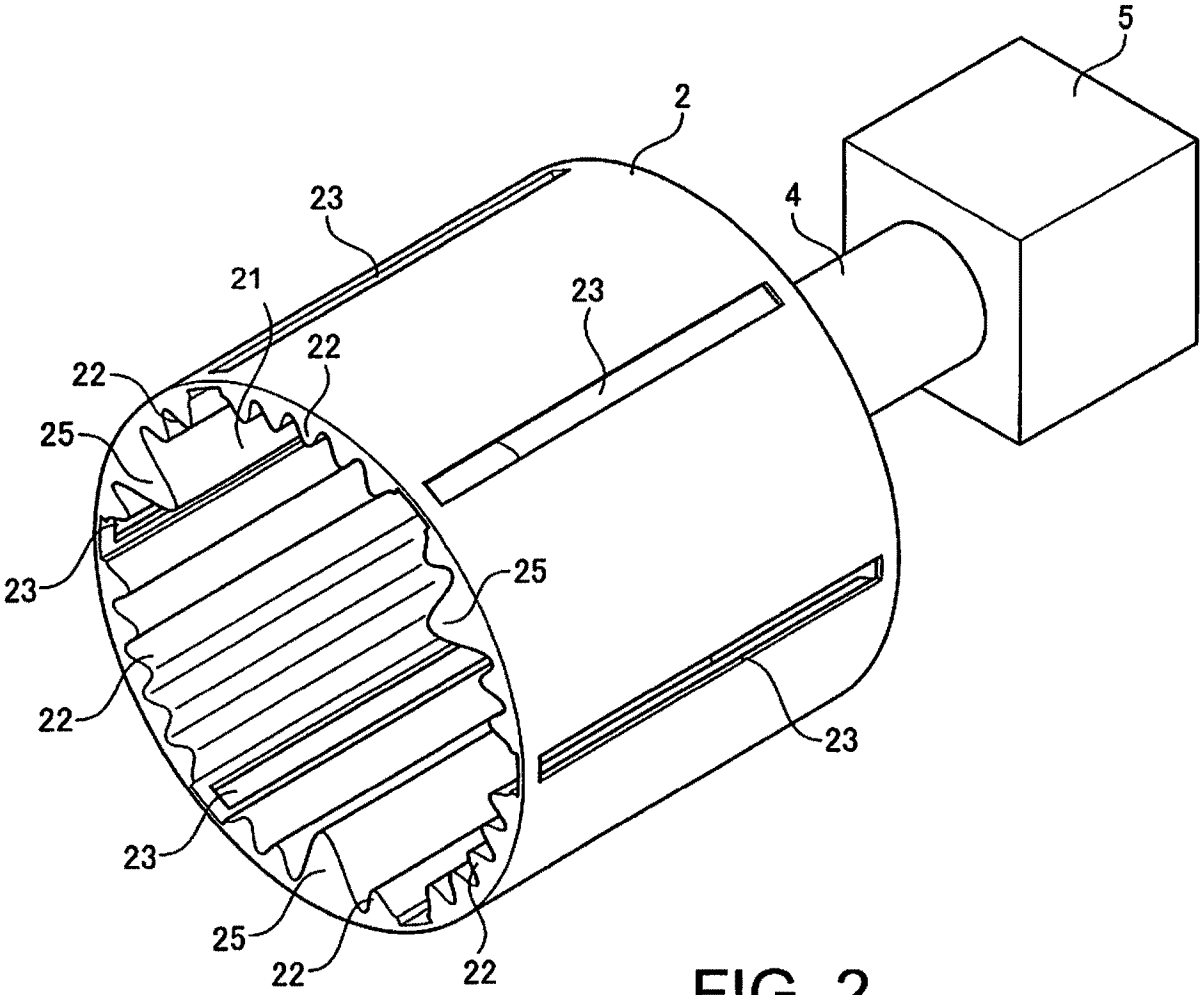
FIG. 2 is a simplified oblique view of the configuration of the laundry tub provided inside the casing of the washing device in FIG. 1.
Figure 3:
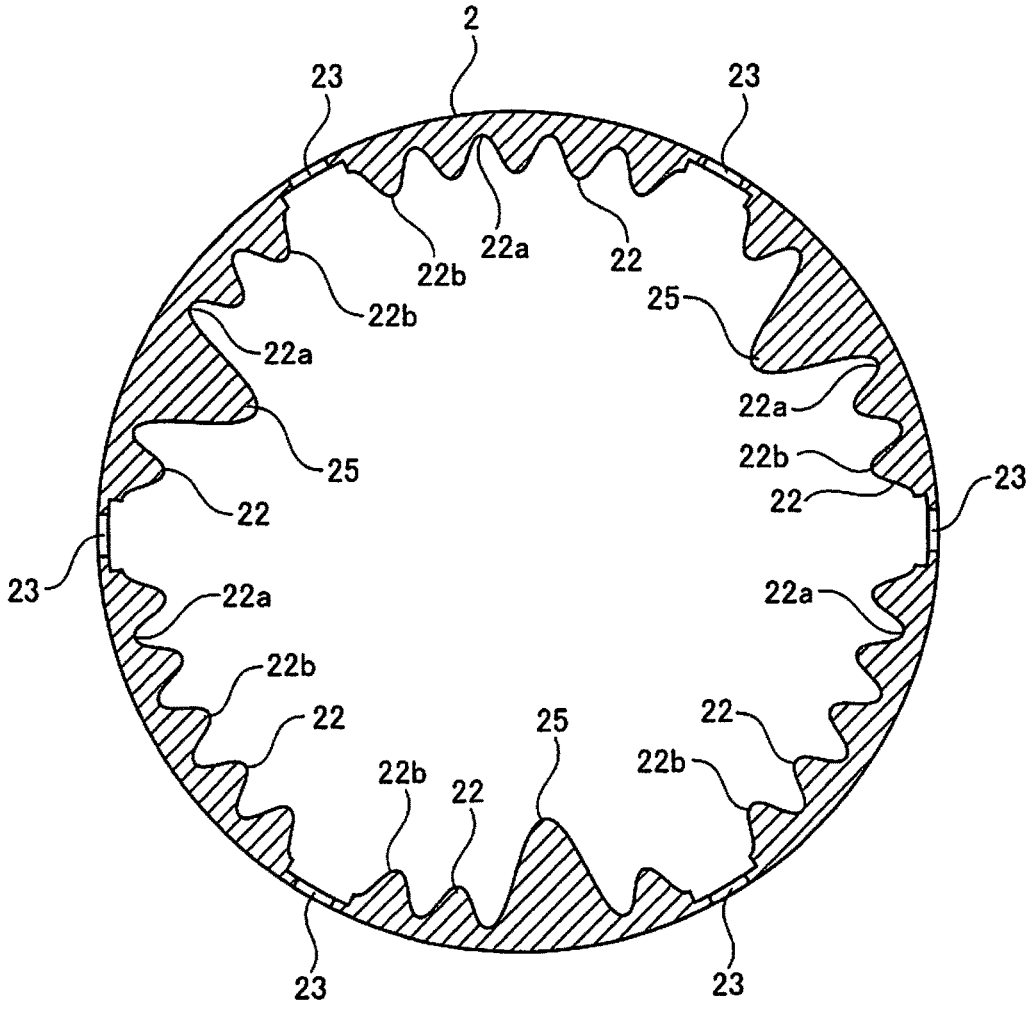
FIG. 3 is a simplified cross section of the laundry tub in a direction perpendicular to the rotational axis of the washing device shown in FIG. 2.
Figure 4:
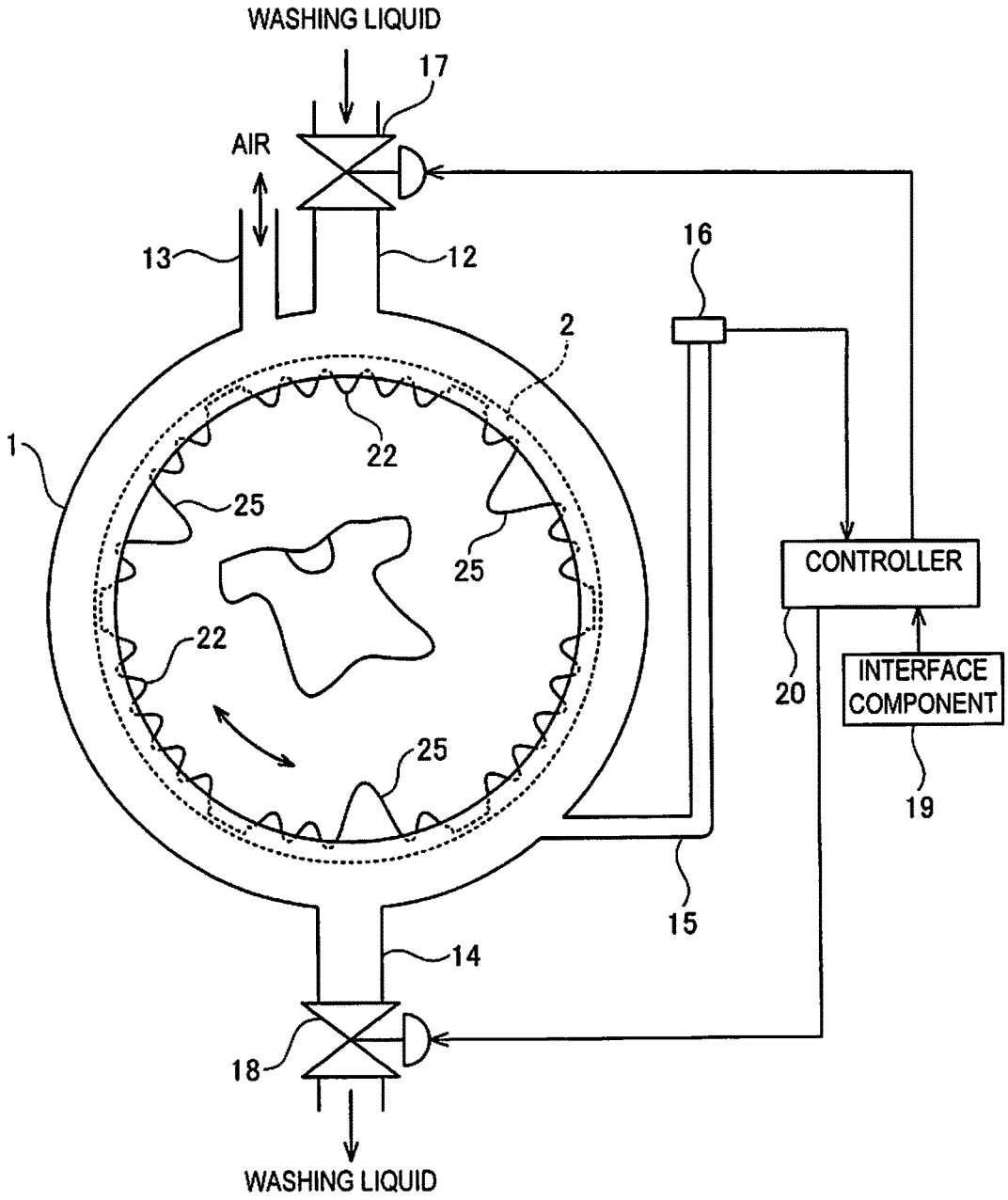
FIG. 4 is a block diagram of the simplified configuration of the control system and the piping system in the washing device.

An embodiment of the present invention will now be described through reference to the drawings. FIG. 1 is a simplified oblique view of the configuration of the washing device used in the washing method of the present invention. FIG. 2 is a simplified oblique view of the configuration of the laundry tub provided inside the casing of the washing device in FIG. 1. FIG. 3 is a simplified cross section of the laundry tub in a direction perpendicular to the rotational axis of the washing device shown in FIG. 2. FIG. 4 is a simplified block diagram of the control system and the piping system in the washing device.

(1) Configuration of Washing Device

The washing device shown in FIG. 1 comprises a casing 1 into the interior of which is supplied a washing liquid, a cylindrical laundry tub 2 provided in the interior of this casing 1, a door 3 that is provided to open up the front side of the casing 1 and that covers a laundry loading opening 11, a rotary shaft 4 that passes through the casing 1 and is connected to the laundry tub 2, and a drive mechanism 5 that transmits rotary force through the rotary shaft 4 and rotates the laundry tub 2. The casing 1 and the laundry tub 2 shown in FIG. 1 are each configured in a cylindrical shape whose center axis is inclined towards the horizontal direction from the vertical direction. Specifically, the laundry tub 2 spins inside the casing 1, with its rotational axis being the center axis, which is either horizontal or a horizontal inclined direction. The casing 1 is not limited to having a cylindrical shape with a cross section that is concentric with the laundry tub 2, and may have any shape that allows the laundry tub 2 to spin freely in its interior.

As shown in FIG. 1, the door 3 has a protruding part that partially sticks into the casing 1 from the loading opening 11, and when the loading opening 11 is closed off by the door 3, the protruding part of the door 3 mates with the loading opening 11, the casing 1 thereby being sealed by the door 3 so that the washing liquid will not leak out. Also, the door 3 may comprise a window that is made of a transparent material such as glass or acrylic, so that the user can see the inside of the casing 1 when the casing 1 has been closed off. This allows the user to visually check the amount of washing liquid supplied into the casing 1, the state of the laundry during washing, and so forth. The drive mechanism 5 may be constituted by an electric motor equipped with the rotary shaft 4, or may be constituted by an electric motor that intermittently rotates the rotary shaft 4 and by a pulley and belt that transmit the rotation of the electric motor to the rotary shaft 4. Also, since this drive mechanism 5 is provided on the outside of the casing 1, the rotary shaft 4 is inserted into the casing 1 and connected to the laundry tub 2. Consequently, the casing 1 is provided with a bearing into which the rotary shaft 4 is inserted. This bearing has a sealed structured so that the washing liquid inside the casing 1 will not leak out.

The configuration of the laundry tub 2 in the washing device thus configured will now be described through reference to FIGS. 2 to 4. As shown in FIG. 2, the laundry tub 2, whose rotational axis is horizontal or in the horizontal inclined direction, has a basket shape that has an opening 21 on one bottom face. The inner wall surface of the laundry tub 2 comprises bumpy curved surfaces 22 having a bumpy shape that is continuous in the peripheral direction in a cross section perpendicular to the rotational axis of the laundry tub 2, slits 23 made so that their lengthwise direction is the direction of the rotational axis of the laundry tub 2, and baffles 25 provided on parts of the bumpy curved surfaces 22. As shown in FIG. 3, the bumpy curved surfaces 22 and the slits 23 are formed alternately along the peripheral direction in a cross section of the inner wall surface of the laundry tub 2 that is perpendicular to the rotational axis of the laundry tub 2. In FIG. 2, the slits 23 are spaced evenly, and the bumpy curved surfaces 22 are formed in between the slits 23, but the slits 23 may instead be provided at different spacings, and the bumpy curved surfaces 22 formed in between the various slits 23.

As shown in FIGS. 2 and 3, the bumpy curved surfaces 22 formed on the inner wall surface of the laundry tub 2 are formed by a curved surface that is continuous in the rotational axis direction of the laundry tub 2 in a cross section of a bumpy shape that is perpendicular to the rotational axis of the laundry tub 2. Specifically, concave parts 22*a* and convex parts 22*b*, whose lengthwise direction is the rotational axis direction of the laundry tub 2, are formed alternately and continuously along the peripheral direction perpendicular to the rotational axis of the laundry tub 2, thus constituting the bumpy curved surfaces 22 on the inner wall surface of the laundry tub 2. Also, since the slits 23 go through from the inner wall of the laundry tub 2 to the outer wall, these slits 23 allow the washing liquid inside the laundry tub 2 to be discharged into the region between the casing 1 and the laundry tub 2, and allow the washing liquid inside the region between the casing 1 and the laundry tub 2 to flow into the laundry tub 2.

With the configuration in FIG. 2, the slits 23 are formed such that their lengthwise direction is the rotational axis direction of the laundry tub 2, but may instead by formed by a plurality of holes arranged in the rotational axis direction of the laundry tub 2. Also, these slits 23 need not be provided on just the inner wall surface that serves as the peripheral surface of the laundry tub 2, and may also be provided on the bottom face opposite the opening 21. Alternatively, they may be constituted by providing gaps between the casing 1 and the opening 21. The slits 23 may also be provided to just the bottom face or between the casing 1 and the opening 21. Furthermore, the configuration of the laundry tub 2 is not limited to one in which the bumpy curved surfaces 22 and the slits 23 are formed alternately on the inner wall surface of the tub, and the configuration may also be such that the bumpy curved surface 22 is formed all the way around the inner wall surface of the laundry tub 2, and the slits 23 are provided to some of the concave parts 22*a*.

The baffles 25 are disposed so that they are sandwiched between two concave parts 22*a* on part of the bumpy curved surfaces 22, and stick out so that their height in the radial direction of the laundry tub 2 is greater than that of the convex parts 22*b*. The baffles 25 are similar to the convex parts 22*b* in that their cross sectional shape, protruding from the inner wall of the laundry tub 2 toward the rotational axis, is a continuous form along the rotational axis of the laundry tub 2. Also, a plurality of the baffles 25 may be provided on the inner wall surface of the laundry tub 2, or just one may be provided. Furthermore, if a plurality of the baffles 25 are provided on the inner wall surface of the laundry tub 2, the baffles 25 are preferably spaced evenly in the peripheral direction of the laundry tub 2. In FIGS. 2 and 3, three baffles 25 stick out from the inner wall surface of the laundry tub 2, but the number is not limited to three, and one or more of the baffles 25 may be provided.

With the laundry tub 2 thus configured, the concave parts 22*a* and the convex parts 22*b* are formed alternately on the bumpy curved surfaces 22 in the peripheral direction of the laundry tub 2, and the baffles 25 are provided in place of the convex parts 22*b*. The change in shape is made gradual at the bottoms of the concave parts 22*a*, the tops of the convex parts 22*b*, and the connections between the concave parts 22*a* and the convex parts 22*b*, so as to produce a smooth curve in a cross section in the peripheral direction of the bumpy curved surfaces 22. Consequently, when the bumpy curved surfaces 22 rotate in the peripheral direction of the laundry tub 2, there will be less disturbance in the flow when the convex parts 22*b* form a flow in a fluid on the inside of the concave parts 22*a*. These bumpy curved surfaces 22 may be formed in the same width in the peripheral direction of the laundry tub 2, or the width may vary along the peripheral direction of the laundry tub 2. The bumpy curved surfaces 22 are formed from thin sheet metal that has been bent, and may be attached to the inner wall surface of the cylindrical cage-shaped laundry tub 2 to which the slits 23 are provided.

Also, as shown in FIG. 4, the washing device in this embodiment comprises at the upper part of the casing 1 a liquid supply channel 12 for supplying washing liquid to the casing 1 and an air channel 13 for the exhaust and intake of air inside the casing 1, and at the lower part of the casing 1 a liquid discharge channel 14 for discharging washing liquid from the casing 1. Furthermore, the device comprises a liquid level measurement pipe 15 and a pressure sensor 16 for measuring the liquid level of the washing liquid supplied into the casing 1. This washing device comprises a flow control valve 17 for controlling the flow of washing liquid supplied from the liquid supply channel 12, a flow control valve 18 for controlling the flow of washing liquid discharged from the liquid discharge channel 14, an interface component 19 that is operated by the user, and a controller 20 that controls the opening and closing of the flow control valves 17 and 18 and designates the valve opening position.

The liquid level measurement pipe 15 here is configured to be connected to the casing 1 at a position that is lower than the center axis of the laundry tub 2, and to be bent in the vertical direction. With this liquid level measurement pipe 15, at an end that is opposite to a connection side to the casing 1, the pressure sensor 16, which measures the pressure inside the liquid level measurement pipe 15, is installed at a position that is higher than the highest point of the laundry tub 2 in the vertical direction. Part of the washing liquid supplied into the casing 1 flows into the liquid level measurement pipe 15 in which the pressure sensor 16 has thus been installed, and the liquid level of this washing liquid in the vertical direction becomes a height position that is the same as the liquid level of the washing liquid inside the casing 1. The pressure sensor 16 then measures the air pressure inside the liquid level measurement pipe 15, and thereby measures the liquid level of the washing liquid inside the liquid level measurement pipe 15, which means that the liquid level inside the casing 1 that becomes the same height as the liquid level in the liquid level measurement pipe 15 is measured.

With a washing device configured in this way, the controller 20 receives a signal based on input details received by the interface component 19, and sets the opening positions of the flow control valves 17 and 18 on the basis of a signal from the pressure sensor 16, according to the input details at the interface component 19. Specifically, when the user operates the interface component 19 and inputs details about the laundry to be washed, the controller 20 calculates the liquid level of the washing liquid supplied into the casing 1 from the details about the laundry loaded into the laundry tub 2. The controller 20 then performs control so that the opening positions of the flow control valves 17 and 18 will be optimal, on the basis of the liquid level indicated by the signal from the pressure sensor 16, so as to maintain the calculated liquid level of the washing liquid.

With the washing device configured as above, the liquid supply channel 12 may be installed in a region that overlaps the laundry tub 2 at the upper part of the casing 1, or may be installed at a position that does not overlap the laundry tub 2. Also, the liquid supply channel 12 may be made up of a plurality of channels running in a direction parallel to the center axis of the laundry tub 2, or may be formed as a single channel. Furthermore, the liquid level measurement pipe 15 and the pressure sensor 16 were used in the above configuration as a liquid level sensor for measuring the liquid level of the washing liquid inside the casing 1, but some other configuration may be used to measure the liquid level by measuring electrostatic capacity or electrical resistance.

Although not shown, just as in Patent Literature 3, a waste liquid processor for reclaiming washing liquid discharged from the liquid discharge channel 14, and a pump may be provided for pumping the reclaimed washing liquid into the liquid supply channel 12 and circulating the washing liquid in the casing 1. Just as in Patent Literature 3, a tank may be provided for temporarily holding the washing liquid that is supplied into the casing 1. Furthermore, just as in Patent Literature 3, an avid valve may be installed in the air channel 13 to prevent the washing liquid inside the casing 1 from leaking out, and if this tank is provided, the air channel 13 may be connected to the tank.

(2) Washing Operation in Simulated Zero-Gravity Washing Mode

With a washing device configured in this way, a washing operation in simulated zero-gravity washing mode and a washing operation in impact washing mode can be executed by adjusting the amount of washing liquid supplied to the laundry tub 2. First, the washing operation in simulated zero-gravity washing mode will be briefly described below. When the washing device configured as above executes a washing operation in simulated zero-gravity washing mode, first the controller 20 sends a control signal to the flow control valves 17 and 18 to open the flow control valve 17 and close the flow control valve 18. Consequently, washing liquid is supplied to the casing 1 from the liquid supply channel 12 until the laundry tub 2 that has been loaded with laundry is submerged in the washing liquid. The controller 20 then receives an electrical signal from the pressure sensor 16, confirms the liquid level of the washing liquid with respect to the laundry tub 2, and determines whether or not it is the liquid level set according to the details about the laundry inputted with the interface component 19.

When a washing operation is executed in simulated zero-gravity washing mode, the liquid level of the washing liquid may be set anywhere between a height that is at or above the center axis of the laundry tub 2 and a height that is higher than the very top of the laundry tub 2 (the height in a state in which the laundry tub 2 has been completely filled with washing liquid). At this point, if a command is given to execute a washing operation in simulated zero-gravity washing mode, basically the liquid level of the washing liquid may be set so that the laundry tub 2 is completely filled with washing liquid. With laundry that has high buoyancy, such as a down jacket with a low specific gravity, an exception made be made so that the liquid level of the washing liquid is set low to form a layer of air at the upper part of the laundry tub 2, creating a state in which the laundry tub 2 is not completely filled with washing liquid.

Once the controller 20 has confirmed that the liquid level of the washing liquid in the laundry tub 2 is high enough to suspend the laundry, the controller 20 drives the drive mechanism 5 to commence the spin of the laundry tub 2. Consequently, the laundry tub 2 spins in the washing liquid inside the casing 1, which causes the laundry in the laundry tub 2 to be suspended and spread out in the washing liquid, and either washing or rinsing with the washing liquid being performed. When rinsing is executed, rinse water is supplied instead of the washing liquid. At this point the controller 20 adjusts the opening of the flow control valves 17 and 18 at the same time that the pump (not shown) is driven, which circulates the washing liquid through the laundry tub 2. A washing operation in simulated zero-gravity washing mode may be executed by closing the flow control valves 17 and 18 when the controller 20 confirms that the washing liquid has filled the casing 1, and spinning the laundry tub 2 without circulating the washing liquid.

At this point, a flow from the inner wall surface side of the laundry tub 2 is formed on the basis of the rotation of the bumpy curved surfaces 22 with respect to the washing liquid that fills the laundry tub 2. The flow of washing liquid generated from the inner wall surface side of the laundry tub 2 propagates toward the rotational axis of the laundry tub 2, generating a pressure distribution in the washing liquid inside the laundry tub 2. This pressure distribution or buoyancy in the washing liquid acts on the laundry, so the laundry exhibits behavior such that it swims in a zero-gravity state while spreading out itself in the washing liquid inside the laundry tub 2, and either washing or rinsing is performed. Also, since layers of different flow speed are formed in the washing liquid in the laundry tub 2, creating a pressure distribution, when the laundry in the washing liquid moves to the inner wall surface side of the laundry tub 2, it exhibits behavior that is affected by the fast flow of the washing liquid.

Specifically, in the washing liquid inside the laundry tub 2, in addition to a large flow in the rotational direction, there are also eddy currents formed by the bumpy curved surfaces 22. Accordingly, this flow of the washing liquid not only prevents the laundry from hitting the inner wall surface of the laundry tub 2, but also moves it forcibly to the rotational axis side. Furthermore, because the difference in flow rates of the washing liquid forms a pressure distribution in the washing liquid, laundry that is affected by the flow rates of the various layers spreads out as it floats in the washing liquid. Consequently, since the laundry presents a larger contact surface with the molecules in the washing liquid, not only is the washing and rinsing with the washing liquid more effective, but the washing causes less damage to the laundry because there is less load such as twisting or collision with the laundry tub based on the flow of the washing liquid.

(3) Washing Operation in Impact Washing Mode

Next, a washing operation in impact washing mode will be briefly described. Just as with a washing operation in simulated zero-gravity washing mode, the controller 20 sends a control signal to open the flow control valve 17 and close the flow control valve 18, and washing liquid is supplied from the liquid supply channel 12 into the casing 1. After this, the controller 20 receives an electrical signal from the pressure sensor 16, and upon confirming that the liquid level of washing liquid in the laundry tub 2 has reached the liquid level set according to the details about the laundry inputted with the interface component 19, the controller 20 sends a control signal to close the flow control valves 17 and 18. The controller 20 then commences the spin of the laundry tub 2 by driving the drive mechanism 5.

In a washing operation in impact washing mode, the liquid level for starting the spin of the laundry tub 2 is set lower than in a washing operation in simulated zero-gravity washing mode, so that it will be set lower than the rotational axis of the laundry tub 2, etc. If the goal is to obtain a good washing effect by impact washing mode, the liquid level of the washing liquid in the laundry tub 2 is set low. On the other hand, if laundry that is unsuited to impact washing mode is to be washed, the liquid level of the washing liquid in the laundry tub 2 may be set higher, and washing performed on the basis of the effect produced by scrub washing. Furthermore, in a washing operation in impact washing mode, the liquid level of the washing liquid in the laundry tub 2 is set to a value corresponding to the amount (volume or weight) of the laundry loaded into the laundry tub 2. Specifically, if a large amount of laundry has been loaded into the laundry tub 2, the liquid level of the washing liquid in the laundry tub 2 is set higher, but if a small amount of laundry has been loaded into the laundry tub 2, the liquid level is set lower.

As discussed above, when the laundry tub 2 spins, this starts the washing or rinsing of the laundry. At this point the rotation of the laundry tub 2 causes the baffles 25 sticking out from the inner wall surface of the laundry tub 2 to rotate, so the laundry at the lower part of the laundry tub 2 is kicked up to a higher position by these baffles 25. The laundry that has been kicked up to the upper part of the laundry tub 2 by the baffles 25 falls under its own weight to the lower part of the laundry tub 2. Thus, the rotation of the baffles 25 agitates the laundry in the laundry tub 2. If at this point the liquid level of the washing liquid in the laundry tub 2 is set low, the agitated laundry will collide with the inner wall surface of the laundry tub 2 as it falls, resulting in impact washing. On the other hand, if the liquid level of the washing liquid in the laundry tub 2 is set high, the laundry will be agitated in the washing liquid so as to tumble along the inner wall surface inside the laundry tub 2, resulting in scrub washing.

When washing is carried out in impact washing mode, since the bumpy curved surfaces 22 are provided to the inner wall surface of the opening 21, the laundry that falls to the inner wall surface of the laundry tub 2 or tumbles over the inner wall surface of the laundry tub 2 collides with the tops of the convex parts 22*b* of the bumpy curved surfaces 22. Since the tops of the convex parts 22*b* are configured as smoothly curving surfaces as mentioned above, damage to the laundry can be suppressed when it falls to the inner wall surface of the laundry tub 2 or tumbles over the inner wall surface of the laundry tub 2.

The shape of the baffles 25 may be such that the laundry will be agitated at a low position in the laundry tub 2, so that washing or rinsing can always be carried out by scrub washing, or conversely, such that the laundry will be agitated at a high position in the laundry tub 2, so that washing or rinsing can always be carried out by impact washing. When washing is performed in impact washing mode, as discussed above, the flow control valves 17 and 18 are closed and the washing liquid does not circulate through the laundry tub 2, but instead of this, the aperture of the flow control valves 17 and 18 may be adjusted and a pump (not shown) driven to circulate the washing liquid through the laundry tub 2, just as in simulated zero-gravity washing mode.

Regardless of whether the above-mentioned simulated zero-gravity washing mode or the impact washing mode is employed, the spinning of the laundry tub 2 during washing or rinsing of the laundry may be such that spinning in just one specific direction is performed continuously for a specific length of time, or such that spinning in one specific direction is performed intermittently at specific time intervals. That is, the laundry tub 2 may be spun continuously for a specific length of time in the forward direction (or reverse direction), or a spin period in which the laundry tub 2 is spun in the forward direction (or reverse direction) and a stop period in which the spinning of the laundry tub 2 is stopped may be repeatedly performed until a certain amount of time has elapsed.

Also, when the spinning of the laundry tub 2 for washing or rinsing is performed intermittently, the spin direction may be switched to the opposite direction every time the spin is commenced intermittently. That is, a spin period in which the laundry tub 2 is spun and a stop period in which the spinning of the laundry tub 2 is stopped may be repeatedly performed until a certain amount of time has elapsed, and the spin direction of the laundry tub 2 may be switched between the forward direction and the opposite direction at every spin period. Here, the stop period may be eliminated, and the spin direction switched to the reverse direction at regular time intervals. Furthermore, when the liquid level is low as in impact washing mode, the laundry tub 2 may be shaken so as to make the laundry tumble over the inner wall surface of the laundry tub 2 when the spin direction is switched, thereby performing washing or rinsing with a scrubbing effect.

With a washing device that executes washing or rinsing in this manner, the washing liquid that is supplied during washing may be either water-based or nonaqueous. Examples of water-based washing liquids include water and compositions in which a surfactant is blended with water. Water-soluble stains can be removed by a water-based washing liquid. When a surfactant is added, it chemically reacts to remove oil-based stains. Examples of nonaqueous washing liquids include petroleum-based (hydrocarbon-based) solvents and organic solvents. These nonaqueous washing liquids can mainly remove oil-based stains, and offer the advantage of faster drying than with a water-based washing liquid.

(4) Wastewater Treatment

The controller 20 measures the degree of soiling of the washing liquid, the washing time, or the like, and when it has thereby confirmed that the washing operation by either simulated zero-gravity washing mode or impact washing mode has ended, it stops the drive mechanism 5 to bring the spinning of the laundry tub 2 to a halt, and opens the flow control valve 18. When the washing liquid is being circulated by a pump (not shown), the controller 20 also stops the operation of this pump. This stops the spinning of the laundry tub 2, and the washing liquid inside the casing 1 is discharged from the liquid discharge channel 14, so the door 3 can be opened and the washed laundry taken out of the laundry tub 2. The washing liquid thus discharged from the casing 1 upon completion of a washing operation is preferably subjected to filtration, chemical treatment, or other such regeneration treatment before being discharge to the outside.

(5) Setting of Washing Operation

The controller 20 may be such that when the interface component 19 is operated to input the type or weight of the laundry, etc., whether to employ simulated zero-gravity washing mode or impact washing mode is determined, and at the same time the liquid level is automatically set. A weight sensor or the like may be provided as part of the interface component 19 here. Specifically, the laundry can be weighed by the weight sensor, and the controller 20 can automatically set the liquid level in impact washing mode, for example. Also, the type of laundry may be inputted by the user with keys or the like on the interface component 19, or information stored by IC tag, barcode, or the like that is attached to the laundry may be read by the interface component 19. Furthermore, rather than having the washing mode and the liquid level be set automatically by the controller 20, they may be set by the user by operating the interface component 19.

As discussed above, the controller 20 controls the washing operation of laundry with a washing liquid by employing either a simulated zero-gravity washing mode or a impact washing mode, after which rinsing is performed to remove the detergent left by the washing liquid in the laundry. At this point, if a good rinsing effective is required, for example, the controller 20 may control the water level in the laundry tub so that the operation in simulated zero-gravity washing mode can be performed according to operation of the interface component 19, and then the laundry may be rinsed. Also, if water conservation is desired, the water level in the laundry tub may be controlled so that the operation in impact washing mode can be performed according to operation of the interface component 19, and then the laundry may be rinsed.

This allows the washing mode employed for washing and the washing mode employed for rinsing to be set independently, so washing and rinsing can be performed with the optimal combination of washing modes according to the type of laundry or the user's preference. Also, in order to make the washing or rinsing more effective, washing and rinsing can be performed in a plurality of cycles that combine washing operations by simulated zero-gravity washing mode and by impact washing mode.

Figure 5:
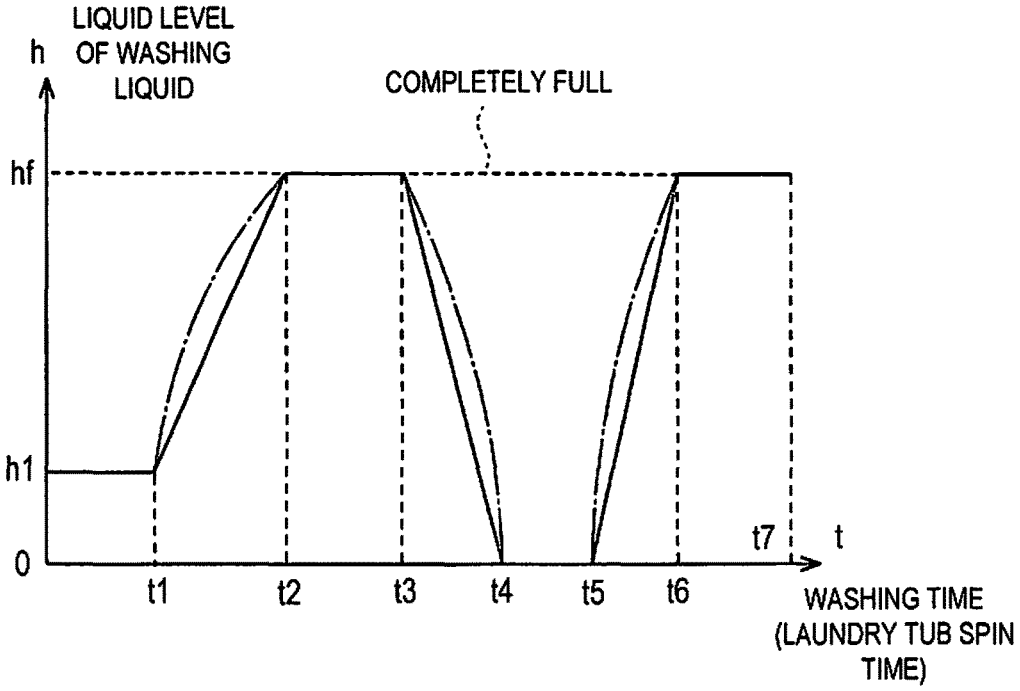
FIG. 5 is a graph of an example of the change in the liquid level in the laundry tub with the washing method of the present invention.
Figure 6:
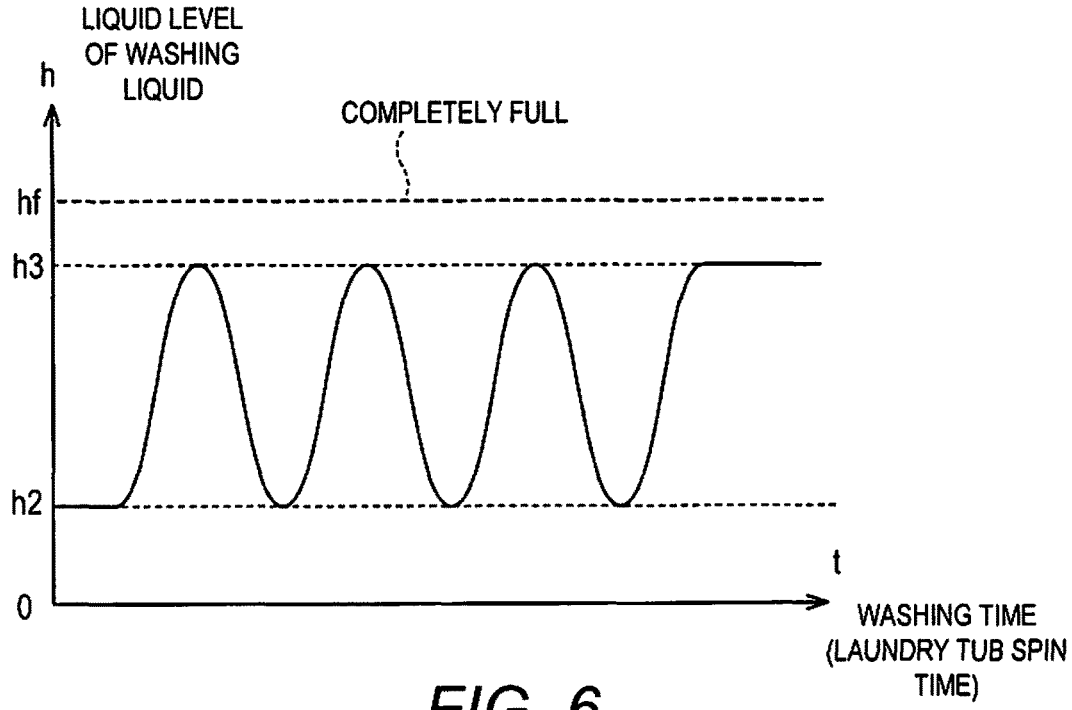
FIG. 6 is a graph of an example of the change in the liquid level in the laundry tub with the washing method of the present invention.
Figure 7:
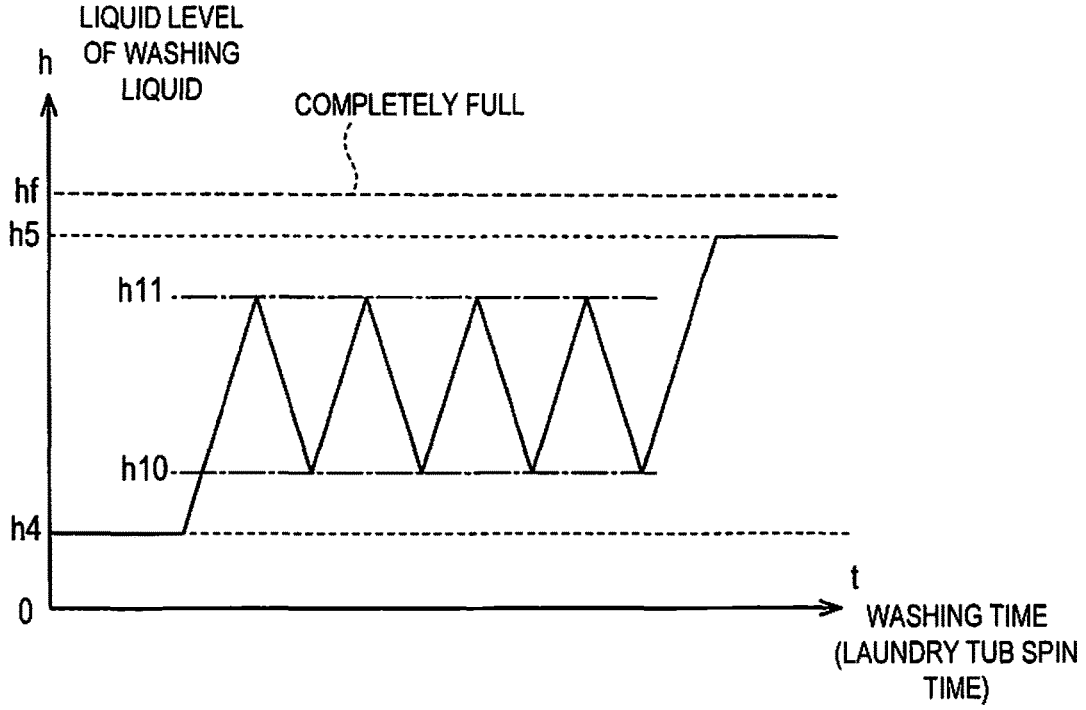
FIG. 7 is a graph of an example of the change in the liquid level in the laundry tub with the washing method of the present invention.

FIGS. 5 to 7 show an example of washing that combines a washing operation by simulated zero-gravity washing mode and a washing operation by impact washing mode. The vertical axis h in each graph is the liquid level in the laundry tub 2, and the horizontal axis t is the washing time, that is, the spin time of the laundry tub 2. The hf line that is labeled as full indicates a height that is higher than the highest level in the laundry tub 2, that is, the height when the laundry tub 2 has been completely filled with washing liquid.

In FIG. 5, the liquid level of the washing liquid supplied to the laundry tub 2 is set low so as to start from a washing operation by impact washing mode, and the value of the liquid level is h1. First, washing by impact washing mode is performed for a t1 length of time, and then the washing liquid is continuously increased in the period from t1 to t2 while the laundry tub 2 is spun. Consequently, the liquid level of washing liquid in the laundry tub 2 continuously increases from h1 to hf.

The effect of continuously increasing the liquid level of the washing liquid while the laundry tub 2 is spun as discussed above is that the liquid level is changed from a washing step in impact washing mode (impact washing step) until a washing step by simulated zero-gravity washing mode (simulated zero-gravity washing step). In this case, as discussed above, the system automatically switches from the impact washing step to the simulated zero-gravity washing step according to the liquid level of washing liquid, but there is an intermediate liquid level in which an intermediate washing operation in between impact washing mode and simulated zero-gravity washing mode comes into play via the above-mentioned scrub washing step. This is believed to be a state in which the laundry is suspended while moving up and down (this will be called butterfly washing). It is anticipated that adding this washing operation to the procedure will enhance the effect of removing stains from the laundry.

Washing is then performed in simulated zero-gravity washing mode in the period from t2 to t3, and then the washing liquid is drained to lower the lever in the period from t3 to t4, and the liquid level of the washing liquid in the laundry tub 2 is continuously reduced from hf to 0. Consequently, the process goes through the simulated zero-gravity washing step and the scrub washing step before reaching the impact washing step, so stains can be further removed.

In the example in FIG. 5, the liquid level of the washing liquid is zero (all of the washing liquid drained) in the period from t4 to t5. When the laundry tub is spun in this state in which there is no washing liquid present, the laundry tumbles over the bumpy curved surfaces 22. Consequently, if the laundry is made up of fibers, the warp and weft yarns of the laundry fabric can be properly arranged, so a smoothing effect can be obtained in which the shape and texture of the laundry are put in order.

As discussed above, the liquid level of washing liquid in the laundry tub is continuously increased or decreased between the impact washing step and the simulated zero-gravity washing step, which means that not only is washing performed by impact washing step and simulated zero-gravity washing step, but also by butterfly washing and scrub washing that are intermediate between these, so an extremely good stain removal effect can be obtained.

Also, in FIG. 5, after the laundry tub has been spun in a state in which there is no washing liquid present, washing liquid is supplied and the liquid level continuously raised during the period from t5 to t6, again going through impact washing, scrum washing, and butterfly washing, eventually reaching the simulated zero-gravity washing step, and the simulated zero-gravity washing is performed in the period from t6 to t7, which is the end. Thus, the liquid level of washing liquid is continuously and repeatedly increased and decreased between the impact washing step and the simulated zero-gravity washing step, so that washing is repeatedly executed in different washing modes, and this enhances the stain removal effect even more.

When the liquid level of the washing liquid in the laundry tub is varied during washing, the process may start with either the impact washing step or the simulated zero-gravity washing step and end with the simulated zero-gravity washing step, or may start with either the impact washing step or the simulated zero-gravity washing step and end with the impact washing step. However, in order to smooth out the shape and texture of laundry (clothing, etc.) whose shape and texture have been mussed, and reduce the ironing time required after washing, the final step is preferably the simulated zero-gravity washing step. This is to take advantage of the smoothing effect had by the simulated zero-gravity washing step.

As shown by the solid lines or one-dot chain lines in FIG. 5, the increase or decrease in washing liquid in the laundry tub 2 may be linear (solid lines), or may be a curve (one-dot chain lines), or may be continuous. Furthermore, the increase or decrease in washing liquid may be intermittent, in which the increase or decrease is halted midway through the process, and then started again.

FIG. 6 is an example of a washing method in which the liquid level of washing liquid may be set low so as to form a layer of air at the upper part of the laundry tub 2 when the laundry is a type that has high buoyancy, such as a down jacket with a low specific gravity. In this case, there is no need for the laundry tub to be completely filled with washing liquid, and the liquid level is h3. An example is shown in which the liquid level is increased and decreased periodically along a sine curve between the liquid levels h3 and h2.

FIG. 7 is similar to FIG. 6 in that it is an example of when there is no need for the laundry tub to be completely filled with washing liquid, and the liquid level is set at h5, but in this example, the washing liquid is increased or decreased linearly over just the range of h10 to h11, in the region of liquid level in which butterfly washing is believed to be performed, between the liquid level h4 at which the impact washing step is executed and the liquid level h5 at which the simulated zero-gravity washing step is executed.

The invention claimed is:

1. A washing method for a washing device including:

a laundry tub that is spun spinnable by a rotary shaft that is horizontal or is inclined towards a horizontal direction from a vertical direction, and in an interior of which laundry is held;

a casing that covers the laundry tub and into which a washing liquid is supplied;

a bumpy curved surface that is provided on an inner wall surface of the laundry tub, and that is bumpy in a radial direction of the laundry tub; and at least one baffle that protrudes from the inner wall surface of the laundry tub in the radial direction of the laundry tub, and that has a height in the radial direction of the laundry tub that is greater than a height of a convex part of the bumpy curved surface, the washing method comprising:

suspending and washing the laundry in a washing liquid that is supplied to the laundry tub at a first liquid level of the washing liquid, the first liquid level of the washing liquid in the suspending and washing of the laundry being set between a height that is at or above a center axis of the laundry tub and a height that is higher than a very top of the laundry tub;

agitating and washing the laundry with the baffle in the washing liquid at a second liquid level that is lower than the first liquid level of the washing liquid that is supplied to the laundry tub during the suspending and washing of the laundry, the second liquid level of the washing liquid in the agitating and washing of the laundry being set lower than the center axis of the laundry tub; and washing the laundry with increasing or decreasing a liquid level of the washing liquid continuously between the first liquid level of the washing liquid and the second liquid level of the washing liquid while the laundry tub is spinning.

2. The washing method according to claim 1, wherein the increasing or decreasing of the liquid level of the washing liquid between the first liquid level of the washing liquid and the second liquid level of the washing liquid includes both a first process in which the liquid level of the washing liquid is continuously increased between the suspending and washing of the laundry and the agitating and washing of the laundry while the laundry tub is spinning, and a second process in which the liquid level of the washing liquid is continuously decreased between the suspending and washing of the laundry and the agitating and washing of the laundry while the laundry tub is spinning.

3. The washing method according to claim 2, wherein washing of the laundry is ended by the suspending and washing of the laundry.

4. The washing method according to claim 2, further comprising spinning the laundry tub in a state in which the liquid level of the washing liquid inside the laundry tub is at zero.

5. The washing method according to claim 2, wherein a spin period in which the laundry tub is spinning and a stop period in which spinning of the laundry tub is stopped are carried out repeatedly.

6. The washing method according to claim 2, wherein a spin period in which the laundry tub is spinning and a stop period in which spinning of the laundry tub is stopped are carried out repeatedly, and a spin direction of the laundry tub is switched between forward and reverse at every spin period.

7. The washing method according to claim 2, wherein at least one of the first process and the second process is executed repeatedly.

8. The washing method according to claim 7, wherein washing of the laundry is ended by the suspending and washing of the laundry.

9. The washing method according to claim 7, further comprising spinning the laundry tub in a state in which the liquid level of the washing liquid inside the laundry tub is at zero.

10. The washing method according to claim 7, wherein a spin period in which the laundry tub is spinning and a stop period in which spinning of the laundry tub is stopped are carried out repeatedly.

11. The washing method according to claim 7, wherein a spin period in which the laundry tub is spinning and a stop period in which spinning of the laundry tub is stopped are carried out repeatedly, and a spin direction of the laundry tub is switched between forward and reverse at every spin period.

12. The washing method according to claim 1, wherein washing of the laundry is ended by the suspending and washing of the laundry.

13. The washing method according to claim 12, further comprising spinning the laundry tub in a state in which the liquid level of the washing liquid inside the laundry tub is at zero.

14. The washing method according to claim 12, wherein a spin period in which the laundry tub is spinning and a stop period in which spinning of the laundry tub is stopped are carried out repeatedly.

15. The washing method according to claim 12, wherein a spin period in which the laundry tub is spinning and a stop period in which spinning of the laundry tub is stopped are carried out repeatedly, and a spin direction of the laundry tub is switched between forward and reverse at every spin period.

16. The washing method according to claim 1, further comprising spinning the laundry tub in a state in which the liquid level of the washing liquid inside the laundry tub is at zero.

17. The washing method according to claim 16, wherein a spin period in which the laundry tub is spinning and a stop period in which spinning of the laundry tub is stopped are carried out repeatedly.

18. The washing method according to claim 16, wherein a spin period in which the laundry tub is spinning and a stop period in which spinning of the laundry tub is stopped are carried out repeatedly, and a spin direction of the laundry tub is switched between forward and reverse at every spin period.

19. The washing method according to claim 1, wherein a spin period in which the laundry tub is spinning and a stop period in which spinning of the laundry tub is stopped are carried out repeatedly.

20. The washing method according to claim 1, wherein a spin period in which the laundry tub is spinning and a stop period in which spinning of the laundry tub is stopped are carried out repeatedly, and a spin direction of the laundry tub is switched between forward and reverse at every spin period.

* * * * *